US012196523B2

(12) United States Patent
Stacy

(10) Patent No.: US 12,196,523 B2
(45) Date of Patent: Jan. 14, 2025

(54) CAM ASSEMBLIES, COMPOUND BOWS EQUIPPED WITH CAM ASSEMBLIES, AND METHODS OF USING COMPOUND BOWS

(71) Applicant: Lance A. Stacy, Crown Point, IN (US)

(72) Inventor: Lance A. Stacy, Crown Point, IN (US)

( * ) Notice: Subject to any disclaimer, the term of this patent is extended or adjusted under 35 U.S.C. 154(b) by 19 days.

(21) Appl. No.: 18/156,599

(22) Filed: Jan. 19, 2023

(65) Prior Publication Data

US 2023/0228519 A1 Jul. 20, 2023

Related U.S. Application Data

(60) Provisional application No. 63/301,243, filed on Jan. 20, 2022.

(51) Int. Cl.
*F41B 5/12* (2006.01)
*F41B 5/10* (2006.01)

(52) U.S. Cl.
CPC ..... *F41B 5/105* (2013.01); *F41B 5/10* (2013.01)

(58) Field of Classification Search
CPC ..... F41B 5/105; F41B 5/10; F41B 5/123
USPC ..... 124/25.6
See application file for complete search history.

(56) References Cited

U.S. PATENT DOCUMENTS

| | | | | |
|---|---|---|---|---|
| 4,757,799 | A * | 7/1988 | Bozek | F41B 5/10 124/900 |
| 4,971,020 | A * | 11/1990 | Soderstrom | F41B 5/105 124/900 |
| 5,950,609 | A * | 9/1999 | Thielen | F41B 5/10 124/25.6 |
| 6,691,692 | B1 * | 2/2004 | Adkins | F41B 5/10 124/900 |
| 8,893,694 | B1 * | 11/2014 | DeBole | F41B 5/10 124/25.6 |
| 10,473,417 | B1 * | 11/2019 | Peacemaker | F41B 5/10 |
| 10,641,577 | B1 * | 5/2020 | Archer | F41B 5/1469 |
| 2013/0061839 | A1 * | 3/2013 | Asherman | F41B 5/10 124/31 |
| 2015/0377581 | A1 * | 12/2015 | Obteshka | F41B 5/105 29/402.01 |
| 2017/0131057 | A1 * | 5/2017 | Farren | F41B 5/105 |

* cited by examiner

*Primary Examiner* — John E Simms, Jr.
(74) *Attorney, Agent, or Firm* — Hartman Global IP Law; Gary M. Hartman; Domenica N.S. Hartman

(57) ABSTRACT

Cam assemblies and methods of propelling an arrow with a compound bow having a pair of limbs, a bowstring, a cable, a draw cam coupled to the bowstring, and a limb cam coupled to the cable. Such a method includes drawing the bowstring a first time to rotate the draw cam and the limb cam in a first direction, releasing the bowstring to rotate the draw cam in an opposite direction to the first direction while the limb cam remains substantially stationary and then drawing the bowstring at least a second time to rotate the draw cam and the limb cam in the first direction and thereby multiply energy stored in the limbs beyond the energy stored by the limbs during the first draw.

3 Claims, 5 Drawing Sheets

CAM ASSEMBLIES, COMPOUND BOWS EQUIPPED WITH CAM ASSEMBLIES, AND METHODS OF USING COMPOUND BOWS

CROSS-REFERENCE TO RELATED APPLICATIONS

This application claims the benefit of U.S. Provisional Application No. 63/301,243 filed Jan. 20, 2022, the contents of which are incorporated herein by reference.

BACKGROUND OF THE INVENTION

The present invention generally relates to archery bows. The invention particularly relates to a cam system for compound bows that allows for storing energy in limbs thereof in excess of the draw weight and draw length.

Traditional archery bows (e.g., longbows and recurve bows) are ranged weapons that utilize a bowstring connected to an elastic member to propel a projectile (arrow). The elastic member generally comprises a pair of elastic limbs joined by and extending from a central attachment piece referred to as a riser. Distal ends of the limbs are connected by the bowstring, in which tension is created by elastic deformation induced in the limbs by the bowstring. Pulling the bowstring away from the riser, referred to as "drawing" the bowstring, bends the limbs toward the bowstring causing compression forces to be exerted on the bowstring-facing section (i.e., "belly") of the limbs while tension forces are simultaneously exerted on the outer section (i.e., "back") of the limbs. These compression and tension forces store energy in the limbs while the bowstring is drawn, and subsequent release of the bowstring transfers this stored energy through the bowstring to the arrow thereby propelling the arrow forward, that is, in a direction away from the bowstring and toward and past the riser.

The force required to hold the bowstring stationary at full draw is often used to express the power of these types of bows, and is known as its draw weight, or weight. The direct link between the tension on the bowstring and the pulling force of the limbs results in a maximum bowstring tension at full draw. This maximum tension must be held by an archer while aiming and shooting, which may cause fatigue and reduce accuracy. Compound bows address this issue by using a system of pulleys (commonly referred to as cams) to bend the limbs. This grants the archer a mechanical advantage that allows for stiffer limbs, which are capable of promoting accuracy. In addition, the shapes of the cams may be adjusted to provide certain modifications to the draw-stroke profile. For example, a nonlinear relationship may be provided between the bowstring tension and the limb tension allowing for an increase in maximum energy stored in the limbs. Further, eccentric cams are commonly used to provide a transition in the draw-stroke profile where draw weight reaches a peak and then decreases as the bow approaches full draw such that the force required by an archer to maintain full draw is greatly reduced without reducing the energy stored in the limbs. The percent-difference between the maximum force encountered during the draw and the force required to hold the bow in full extension is referred to as "let-off."

FIG. 1A schematically represents a dual (twin) cam compound bow 10, and FIG. 1B represents an exemplary dual cam compound bow 10 of a type known in the art. In each representation, the bow 10 includes a riser 12 having a grip (or handle) 13 thereon, a pair of limbs 14 coupled to opposite ends of the riser 12, a pair of cam assemblies 16 coupled to distal ends of the limbs 14, and a pair of cables 18 (sometimes referred to as "power cables," "control cables," "buss cables," "limb strings," etc.) and a bowstring 20 (sometimes referred to as a "draw cable"), each extending between and coupled to the cam assemblies 16. Each of the cam assemblies 16 is represented as comprising a pair of cams each rotatably mounted on an axle (axis) 26 to each limb 14. In FIG. 1A, a first set of the cams, referred to hereinafter as limb cams 22, interact with the cables 18, and a second set of the cams, referred to hereinafter as draw cams 24, are each connected to opposite ends of the bowstring 20 and to one end of each cable 18. Opposite ends of the cables 18 are coupled to a respective limb 14 on an end of the bow 10 opposite to the draw cams 24 coupled to the cables 18. The cables 18 are received in tracks of the limb cams 22, and the limb cams 22 are configured to interact with the cables 18 while the bowstring 20 is being drawn to modify the draw-stroke profile.

When the compound bow 10 is drawn, the bowstring 20 unwinds from tracks in the draw cams 24 and causes rotation thereof. The limb cams 22 and the draw cams 24 have a fixed rotational relationship, such rotation of the draw cams 24 due to drawing of the bowstring 20 also rotates the limb cams 22. As the limb cams 22 rotate, the cables 18 received in the tracks thereof and pulled around the limb cams 22, resulting in the limbs 14 being bent toward one another so that energy is stored in the limbs 14.

While compound bows offer many advantages, the maximum energy stored in their limbs is still limited by, at least in part, the draw length and the draw weight. Since the maximum energy stored correlates to the effectiveness of the weapon, it can be appreciated that it would be desirable to increase the maximum energy that may be stored in the limbs of compound bows.

BRIEF DESCRIPTION OF THE INVENTION

The present invention provides, but is not limited to, cam assemblies, compound bows comprising such cam assemblies, and methods of using such bows that are suitable for storing energy in the limbs of the bows in excess of that of the draw weight and draw length of the bows in the absence of the cam assemblies.

According to a nonlimiting aspect of the invention, a method is provided for propelling an arrow with a compound bow that includes a pair of limbs, a bowstring, a cable, a draw cam coupled to the bowstring, and a limb cam coupled to the cable. The method includes drawing the bowstring a first time to rotate the draw cam and the limb cam in a first direction, releasing the bowstring to rotate the draw cam in an opposite direction to the first direction while the limb cam remains substantially stationary, and then drawing the bowstring a second time to rotate the draw cam and the limb cam in the first direction and thereby multiply energy stored in the limbs during the second time beyond energy stored by the limbs during the first time.

According to another nonlimiting aspect of the invention, a cam assembly is provided for a compound bow having a pair of limbs, a bowstring, and at least one cable. The cam assembly includes a draw cam configured to rotatably connect to at least one of the pair of limbs, to connect to the bowstring and receive a portion of the bowstring in a track of the draw cam, to rotate about an axis of rotation in a first direction upon drawing the bowstring, and to rotate about the axis of rotation in an opposite direction to the first direction upon release of the bowstring, a limb cam configured to rotate about the axis of rotation in the first direction upon rotation of the draw cam in the first direction, and to receive at least a portion of the at least one cable in a track of the limb cam and change an effective distance of the cable from the axis of rotation as the limb cam rotates with the cable in the track thereof and thereby modify a draw-stroke profile of the bowstring. The cam assembly provides the capability of storing energy in the limb, maintaining the stored energy in the limb independent of tension on the bowstring, and selectively applying the stored energy to the bowstring upon release of the bowstring.

Other aspects of the invention include compound bows including one or more cam assemblies of the type described above.

Technical effects of the cam assemblies, compound bows, and methods described above preferably include the ability to propel arrows with a force that is in excess of that capable of being produced with a single draw cycle of the compound bows.

Other aspects and advantages of this invention will be appreciated from the following detailed description.

DETAILED DESCRIPTION OF THE INVENTION

Figure 1A:
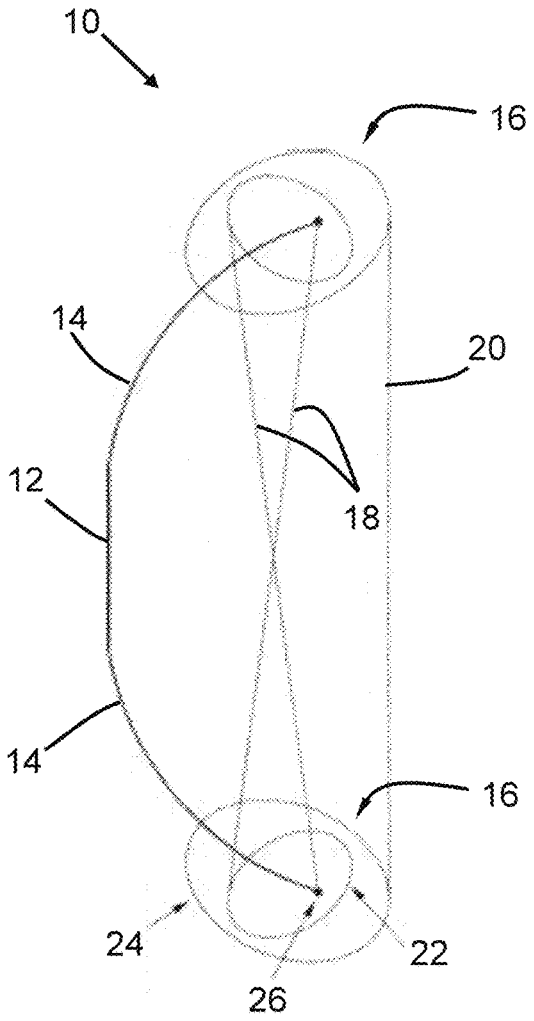
FIG. 1A (Prior Art)
FIG. 1A schematically represents a dual (twin) cam compound bow.

The intended purpose of the following detailed description of the invention and the phraseology and terminology employed therein is to describe what is shown in the drawings, which include the depiction of one or more nonlimiting embodiments of the invention, and to describe certain but not all aspects of what is depicted in the drawings, including the embodiment(s) depicted in the drawings. The following detailed description also identifies certain but not all alternatives of the embodiment(s) depicted in the drawings. As nonlimiting examples, the invention encompasses additional or alternative embodiments in which one or more features or aspects shown and/or described as part of a particular embodiment could be eliminated, and also encompasses additional or alternative embodiments that combine two or more features or aspects shown and/or described as part of different embodiments. Therefore, the appended claims, and not the detailed description, are intended to particularly point out subject matter regarded to be aspects of the invention, including certain but not necessarily all of the aspects and alternatives described in the detailed description.

FIGS. 5 through 11 schematically represent a cam assembly 130 adapted to be installed and used in combination with compound bows. The cam assembly 130 is intended to have a capability of selectively storing energy in a bow independent of the tension applied to a bowstring thereof. Effectively, this allows for the storage of energy in the bow in excess of that otherwise provided by draw weight and draw length, and therefore provides for improvements in bow performance such as improved projectile speed, accuracy, and impact force. The cam assembly 130 may be used with compound bows having various constructions and various cam profiles (i.e., bow eccentrics) including twin or dual cams, hybrid cams, single cams, and binary cams.

Figure 1B:
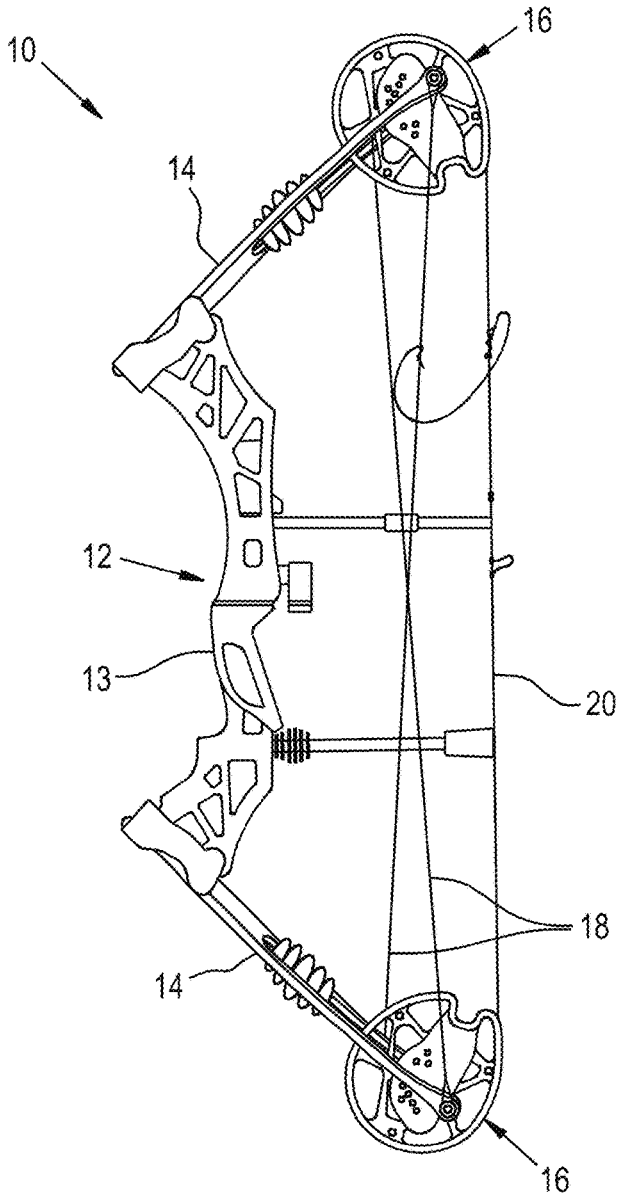
FIG. 1B (Prior Art)
FIG. 1B represents an exemplary dual cam compound bow of a type known in the art.

The cam assembly 130 is preferably capable of use in combination with a compound bow that is similar in general construction to the dual (twin) cam compound bow 10 represented in FIGS. 1A and 1B. For convenience, nonlimiting embodiments of the cam assembly 130 will be described hereinafter in reference to the bow 10 represented in FIGS. 1A and 1B, though it will be appreciated that the teachings of the invention are also generally applicable to other types of bows. The following discussion will focus primarily on certain aspects of the cam assembly 130 and the bow 10 when modified to be equipped with a pair the cam assembly 130, whereas other aspects of the bow 10 and cam assembly 130 not discussed in any detail may be, in terms of structure, function, materials, etc., essentially as was described in reference to FIGS. 1A and 1B.

As with the prior art cam assemblies 16 represented in FIGS. 1A and 1B, the cam assembly 130 is configured to provide for selectively storing energy in the limbs 14 of the bow 10 independent of the tension applied to the bowstring 20 thereof, and selectively using such energy to propel an arrow. Similar to the prior art cam assemblies 16 represented in FIGS. 1A and 1B, the cam assembly 130 represented in FIGS. 5 through 11 comprises a limb cam 132 and a draw cam 134 rotatably mounted together on an axle (axis) 136. A pair of such cam assemblies 130 are in turn capable of being mounted to the bow limbs 14 similar to what is represented for the bow 10 of FIGS. 1A and 1B. In a nonlimiting embodiment represented in FIGS. 5A and 5B, each cam assembly 130 further comprises a gear system (comprising a ring gear 203, planet gears 204, and a sun gear 205), a clutch mechanism (comprising sets of one-way bearings 206 and 212 mounted on the axle 136), and a locking mechanism (comprising a slide lock 209, pin pocket 210, and spring-loaded locking pin 211) each functionally coupled between its limb cam 132 and draw cam 134. The gear system (203, 204, 205) is configured to functionally couple and connect the limb cam 132 and the draw cam 134 and provide for simultaneous rotation of the limb cam 132 in response to rotation of the draw cam 134. The clutch mechanism (136, 206, 212) is configured to selectively decouple the limb cam 132 and the draw cam 134 such that the limb cam 132 and the draw cam 134 may rotate and function independently of each other. The locking mechanism (209, 210, 211) is configured to lock the limb cam 132 and maintain the rotational position thereof when the limb cam 132 and the draw cam 134 are decoupled by the clutch mechanism (136, 206, 212) and the draw cam 134 is caused to rotate independently of the limb cam 132. This configuration allows for energy to be stored in the limbs 14 and maintained therein with the limb cam 132 and the cables 18 of the bow 10 independent of the draw cam 134 and the bowstring 20 coupled thereto.

Figures 5A, 5B:
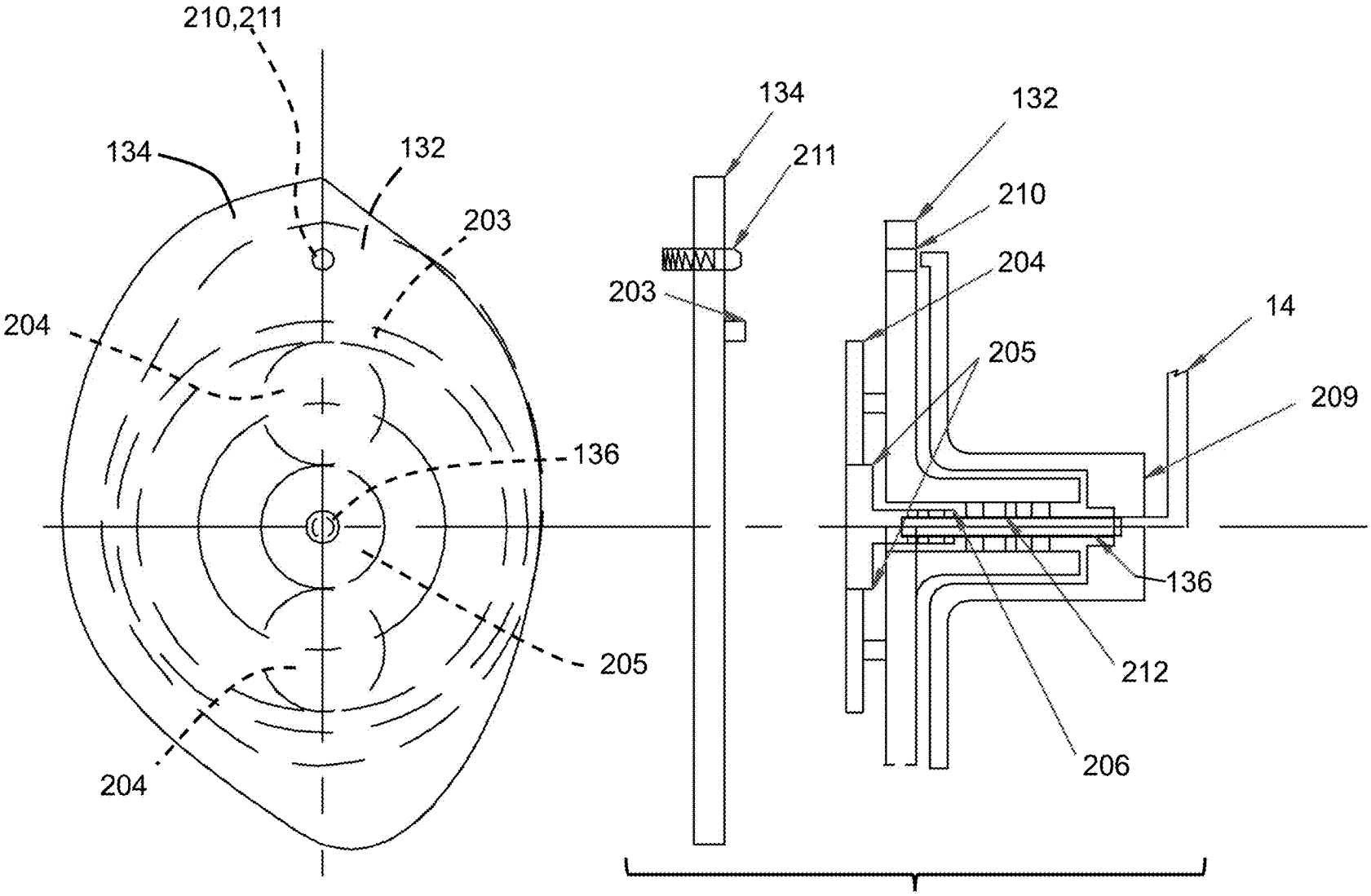
FIGS. 5A and 5B represent plan and cross-sectional views of a cam assembly in accordance with certain nonlimiting aspects of the invention.

Referring now to the embodiment represented in FIGS. 5A and 5B of one of the cam assemblies 130, FIG. 5A shows the draw cam 134 with the limb cam 132 behind it and the gear system (203, 204, 205) and clutch mechanism (136, 206, 212) behind the limb cam 132. FIG. 5B illustrates how the draw cam 134 and limb cam 132 can be selectively geared to each other during the draw phase and then turn together on the release. In the embodiment of FIGS. 5A and 5B, the gear system (203, 204, 205) is a planetary gear system that connects the draw cam 134 to the limb cam 132. The ring gear 203 of the planetary gear system is directly mounted to the draw cam 134. The limb cam 132 acts as a planet gear carrier to which the planet gears 204 are rotatably mounted. The sun gear 205 of the planetary gear system is mounted to the axle 136 via a one-way bearing 206 such that the sun gear 205 can only rotate in one direction. The axle 136 is held stationary to the limb 14 through the slide lock 209 of the locking mechanism (209, 210, 211).

As the draw cam 134 is rotated, the ring gear 203 drives the planet gear(s) 204. Because the sun gear 205 is being held by the one-way bearing 206, the planet gear carrier (limb cam 132) is forced to rotate. When the string force is released, the limb cam 132 holds that force due to it being locked to the limb 14 through the one-way bearings 212 riding on the axle 136. The draw cam 134 is allowed to return to the start of the draw cycle, and attempts to rotate the limb cam 132 in the opposite direction as the draw cycle. However, because the limb cam 132 is prevented from rotating in that direction due to the one-way bearing 212, the planet gears 204 spin because the sun gear 205 is able to rotate when driven in this direction.

When the draw cam 134 aligns with pin pocket 210 in the limb cam 132, the spring-loaded locking pin 211 passes through the pin pocket 210, locking the draw cam 134 to the limb cam 132 in a one-to-one ratio. As the locking pin 211 pushes through the pin pocket 210 on the limb cam 132, the locking pin 211 pushes against the slide lock 209. This force disengages the axle 136 from the limb 14, which allows both the sun gear 205 and limb cam 132 to rotate freely during the release. When the string is released, the limb cam 132, draw cam 134 and sun gear 205 all rotate at the same rate allowing the energy stored in the limb 14 to be transferred to the draw cam 134, and then to the arrow. After the arrow is shot and before the next draw cycle occurs, the slide lock 209 of each cam assembly 130 re-engages its sun gear 205 to the limb 4. Similarly, the locking pin 211 of each cam assembly 130 is pushed out of its pin pocket 210 against the spring tension until the next draw cycle begins.

The above described features will be further discussed below in reference to FIGS. 2 through 4 and FIGS. 6 through 11, which provide a comparison between the operation of the cam assembly 130 and either prior art cam assembly 16 of FIGS. 1A and 1B. The operations of both cam assemblies 16 and 130 will be described in reference to the bow 10 of FIGS. 1A and 1B.

Figures 2, 3, 4:
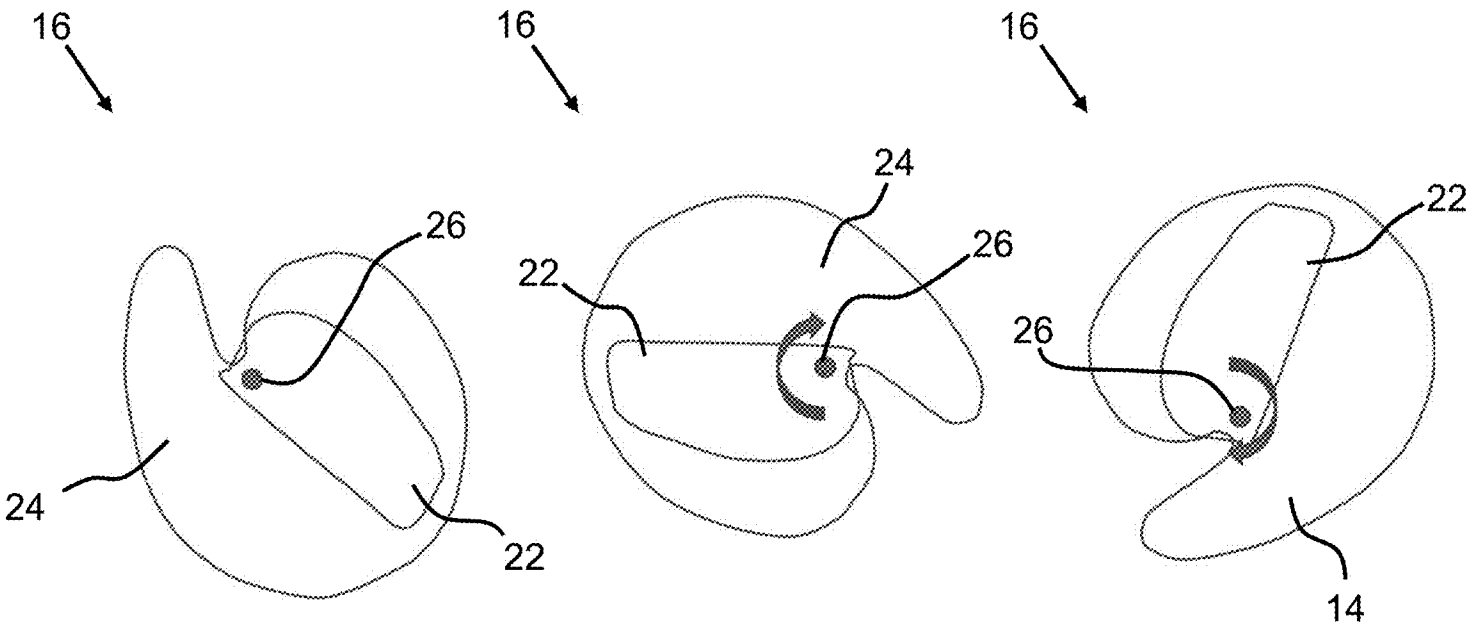
FIG. 2 (Prior Art)
FIG. 3 (Prior Art)
FIG. 4 (Prior Art)
FIGS. 2, 3, and 4 represent a cam assembly of a type known in the art in various cam positions corresponding to undrawn (FIG. 2), mid-draw (FIG. 3), and full draw (FIG. 4) bowstring positions.

FIGS. 2 through 4 represent rotational positioning of the prior art cam assembly 16 during a traditional draw cycle of the bowstring 20, including an initial position (FIG. 2) when the bowstring 20 is not drawn ("undrawn"), an intermediate rotational position (FIG. 3) when the bowstring 20 is at a mid-draw position, and a final rotational position (FIG. 4) when the bowstring 20 is at a full draw position. The limb cam 22 and draw cam 24 of the prior art cam assembly 16 are each configured to rotate about their common axle (axis) 26. The limb cam 22 and draw cam 24 are rotationally fixed relative to each other, and are not adapted to be uncoupled from each other or operate independently of each other while operating the bow 10. Therefore, as the bowstring 20 is drawn, the limb cam 22 and draw cam 24 simultaneously rotate in the same direction (clockwise in FIGS. 3 and 4) at equal rates until reaching the final rotational position (FIG. 4). In the example represented in FIGS. 2 through 4, the limb cam 22 and draw cam 24 rotate at equal rates until full draw is attained, and in the embodiment shown reach the final rotational position after about 210 degrees of rotation from the initial rotational position. Maintaining the stored energy in the limbs 14 requires the bowstring 20 to remain in the full draw position. Release of the bowstring 20 results in both the cams 22 and 24 rapidly and simultaneously rotating counterclockwise at equal rates, thereby transferring the stored energy of the draw from the limbs 14, through the bowstring 20, and to an arrow notched thereon which is propelled with a force corresponding to the released energy.

Figures 6, 7, 8:
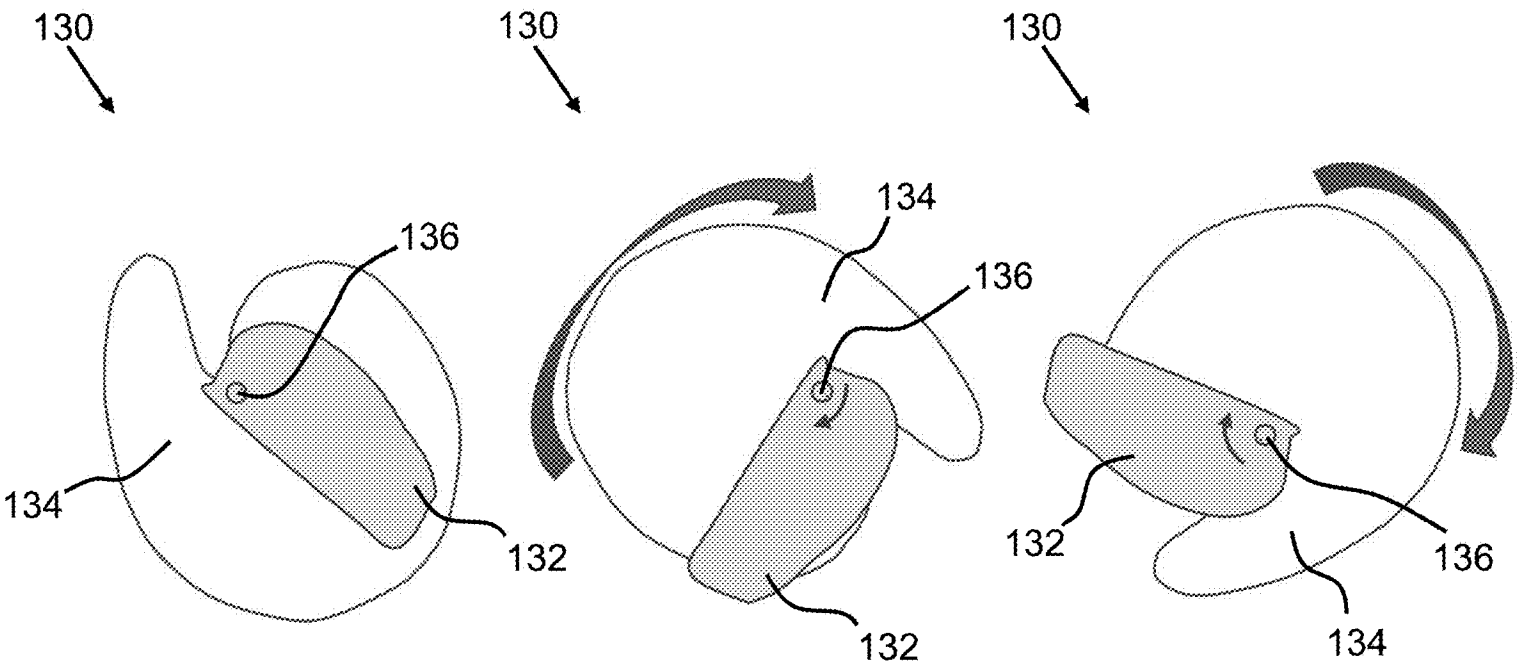
FIGS. 6 through 11 represent the cam assembly of FIGS. 5A and 5B in cam positions corresponding to undrawn (FIGS. 6 and 9), mid-draw (FIGS. 7 and 10), and full draw (FIGS. 8 and 11) bowstring positions during two consecutive draw cycles.
Figures 9, 10, 11:
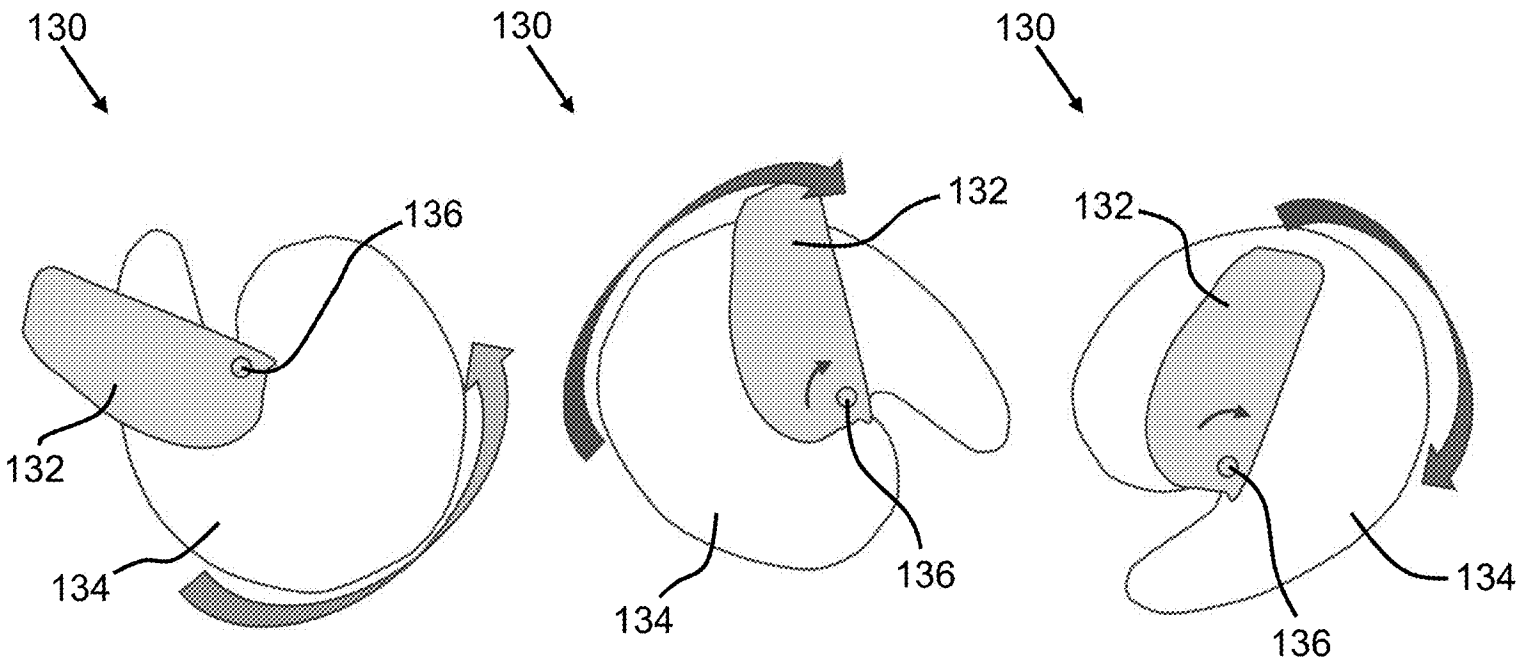

FIGS. 6 through 8 represent positioning of the cam assembly 130 during a first draw cycle and FIGS. 9 through 11 represent positioning of the cam assembly 130 during a subsequent second draw cycle. In FIGS. 6 and 9, the bowstring 20 is referred to as being at an undrawn position, in FIGS. 7 and 10 the bowstring 20 is referred to as being at a mid-draw position, and in FIGS. 8 and 11 the bowstring 20 is referred to as being at a full draw position. The limb cam 132 and draw cam 134 interact with other components of the bow 10, that is, the limbs 14, the cables 18, and the bowstring 20, in substantially the same manner as the limb cam 22 and draw cam 24 of the cam assembly 16. However, in contrast to the prior art cam assembly 16 described above, the limb cam 132 and the draw cam 134 are not rotationally fixed relative to each other and instead are capable of both independent rotation and simultaneous rotation at rate ratios other than 1:1. More specifically, as the bowstring 20 is drawn, the limb cam 132 and the draw cam 134 are configured to simultaneously rotate in the same direction (for example, clockwise in the nonlimiting embodiment of FIGS. 6 through 11) at predetermined unequal rates. As the bowstring 20 is returned to the undrawn position, the draw cam 134 is configured to rotate in the opposite direction (counterclockwise in the nonlimiting embodiment of FIGS. 6 through 11) and the limb cam 132 is configured to selectively simultaneously rotate counterclockwise at a rate equal to the draw cam 134 or, as represented in FIG. 9, remain in a rotationally fixed position.

As represented in FIG. 6, the cam assembly 130 is in an initial state wherein the bowstring 20 of the bow 10 is in an undrawn position and the draw cam 134 and limb cam 132 of the cam assembly 130 are both in an initial rotational position. As the bowstring 20 is pulled, the limb cam 132 and the draw cam 134 simultaneously rotate in the same direction (clockwise in the nonlimiting embodiment of FIGS. 6 through 11) at unequal predetermined rates as determined by the gear system (203, 204, 205). In the nonlimiting but preferred example depicted in the drawings, the limb cam 132 travels roughly half of the rotational distance of the draw cam 134. In the exemplary mid-draw position represented by FIG. 7, the limb cam 132 has traveled about 52.5 degrees whereas the draw cam 134 has traveled about 105 degrees. At the exemplary full draw position represented by FIG. 8, the limb cam 132 has traveled about at about 105 degrees and the draw cam 134 has traveled about 210 degrees. In the nonlimiting example depicted in the drawings, a complete rotational cycle for both the limb cam 132 and the draw cam 134 is considered to be reached after traveling about 210 degrees. Therefore, upon completion of the first draw cycle as represented in FIG. 8, the limb cam 132 has only completed a partial rotational cycle (e.g., half of a full rotational cycle) to reach an intermediate rotational position and the draw cam 134 has finished a complete rotational cycle to reach a final rotational position.

According to a preferred aspect of the invention, by removing tension from the bowstring 20 that exists at the full draw position of FIG. 8, the limb and draw cams 132 and 134 are decoupled from each other by the clutch mechanism (136, 206, 212) and the limb cam 132 is simultaneously locked by the locking mechanism (209, 210, 211) as the bowstring 20 transitions from the full drawn position of FIG. 8 toward the undrawn position, during which time the bowstring 20 winds about the track of the draw cam 134 so that the draw cam 134 rotates (counterclockwise in the nonlimiting embodiment of FIGS. 6 through 11) from its rotational position of FIG. 8 back toward and preferably to its initial rotational position of FIG. 6 but the limb cam 132 substantially remains rotationally stationary, preferably maintaining its intermediate rotational position shown in FIG. 8. The result is different rotational positions for the cams 132 and 134, such as shown in FIG. 9. Since the limb cam 132 is maintained in the intermediate position, the cable 18 contacting the limb cam 132 and the limb 14 connected to the cable 18 also remain stationary such that the energy produced by the full draw of the bowstring 20 remains stored in the limbs 14 of the bow 10. The cam assembly 130 may remain in the position represented in FIG. 9 for an extended period of time, with the energy stored in the limbs 14, without tension on the bowstring 20.

Under the condition depicted in FIG. 9, the bowstring 20 may be subsequently drawn again through a second draw cycle. As with the first draw cycle, drawing the bowstring 20 induces a clockwise rotation in the draw cam 134. This action causes the gear system (203, 204, 205) to recouple the draw cam 134 and the limb cam 132, such that the limb and draw cams 132 and 134 again simultaneously rotate clockwise at the exemplary unequal rates, with the limb cam 132 starting from the intermediate rotational position and the draw cam 134 starting from the initial rotational position. In the exemplary mid-draw position depicted in FIG. 10, the limb cam 132 has traveled about 52.5 degrees for a total of about 157.5 degrees and the draw cam 134 has traveled about 105 degrees. At the exemplary full draw position depicted in FIG. 11, the limb cam 132 has traveled about 105 degrees for a total of about 210 degrees and the draw cam 134 has traveled about 210 degrees. As such, both the limb cam 132 and the draw cam 134 are considered to have finished complete rotational cycles and reached final rotational positions.

Once both the limb cam 132 and draw cam 134 have reached the final rotational positions, the bowstring 20 may be released to propel an arrow notched in the bowstring 20. Since the limb cam 132 is in the final rotational position, the clutch mechanism (136, 206, 212) does not decouple the limb cam 132 and the draw cam 134, nor does the locking mechanism (209, 210, 211) lock the position of the limb cam 132. Instead, both the limb cam 132 and the draw cam 134 rapidly and simultaneously rotate in the counterclockwise direction at equal rates (i.e., a rate ratio of 1:1). As such, the stored energy of both the first and second draws is transferred from the limbs 14, through the bowstring 20, and to the notched arrow, which is propelled with a force corresponding to the combined released energy.

This energy storage capability allows for stored energy from multiple draws to be available during a single release, thereby multiplying the energy available beyond that generated by a single draw based on, at least in part, draw weight and draw length of the compound bow. Further, the initial input and storage of energy may be performed independent of the time of release, that is, substantially any time duration may be provided between the first draw and the second draw and release. Notably, the above example describing a gear reduction ratio of 2:1 between the draw cam 134 and the limb cam 132 is nonlimiting as greater or lesser gear reduction ratios may be used, such as but not limited to 4:3, 3:2, 5:2, 3:1, 7:2, 4:1, etc. Further, the compound bow 10 may be configured to be drawn more than twice prior to a release event intended to propel the arrow.

As a specific nonlimiting example, the compound bow 10 may be configured to store energy in the limbs 14 proportional to a single draw weight of up to 150 lbs. and have a gear reduction ratio of 2:1. In such an example, the maximum stored energy may be reached by completing two full draw cycles wherein the maximum draw weight of both the first and second draws are about 75 lbs. As such, upon release the arrow may be propelled with up to 150 lbs. of force despite the draw weight being limited to 75 lbs. If in the above example the gear reduction ratio is 3:1 instead of 2:1, the maximum stored energy may be reached by completing three full draw cycles wherein the maximum draw weight of each the first, second, and third draws are about 50 lbs. This method may allow weaker archers to achieve sufficient to excellent bow performance (e.g., between about 250 to 350 FPS arrow velocity) and/or allow for overall bow performance in excess of the highest performance possible with currently available compound bows (e.g., greater than about 350 FPS arrow velocity).

In view of the foregoing, the cam assembly 130 provides for a method of operating a bow. For example, with the bow 10 of FIGS. 1A and 1B in the initial state in which the limb and draw cams 132 and 134 of the cam assembly 130 are each in the initial rotational position (FIG. 6), the bowstring 20 may be drawn in an initial draw cycle from the undrawn position (FIG. 6) to the full drawn position (FIG. 8), thereby causing the draw cam 134 and the limb cam 132 to simultaneously rotate in a first (e.g., clockwise) direction from their initial rotational positions to their final and intermediate rotational positions, respectively, during which time energy proportional to the drawing of the bowstring 20 is input into the limbs 14 of the bow 10. At this point, the draw cam 134 and the limb cam 132 can be decoupled by returning the bowstring 20 to its undrawn position from its full drawn position, thereby causing the draw cam 134 to rotate in an opposite (e.g., counterclockwise) direction from the final rotational position to the initial rotational position. During this time, the limb cam 132 is preferably locked in the intermediate position such that the limb cam 132 remains rotationally stationary while the bowstring 20 is returned from the full drawn position to the undrawn position.

The bowstring 20 can then be drawn in a second and possibly final draw cycle from the undrawn position to the full drawn position, thereby causing the draw cam 134 and the limb cam 132 to simultaneously rotate in the first direction to the final rotational position, wherein energy proportional to the drawing of the bowstring 20 is input into the limbs 14 of the bow 10. The bowstring 20 may be released to propel the notched arrow, such that the combined energy input into the limbs 14 of the bow 10 from the initial and second/final draw cycles are transferred through the bowstring 20 to the arrow.

In the above exemplary method, the final rotational position may represent a full rotational cycle and the intermediate rotational position may represent a partial rotational cycle. In such instances, the method preferably includes automatically decoupling the draw cam 134 and the limb cam 132 if the limb cam 132 is not in the final rotational position upon initiating the rotation of the draw cam 134 in the opposite direction.

In some embodiments, the method may include, prior to drawing the bowstring 20 in the final draw cycle, drawing the bowstring 20 in one or more additional draw cycles from the undrawn position to the full drawn position. For example, after the initial draw cycle, the bowstring 20 may be pulled to the full drawn position thereby causing the draw cam 134 and the limb cam 132 to simultaneously rotate in the first direction from the initial and intermediate rotational positions, respectively, to the final rotational position and an additional intermediate rotational position, respectively, wherein energy proportional to the drawing of the bowstring 20 is input into the limbs 14 of the bow 10. In such embodiments, the bowstring 20 may be returned from the full drawn position to the undrawn position thereby causing the draw cam 134 to rotate in the opposite direction from the final rotational position to the initial rotational position, the limb cam 132 may be locked in the additional intermediate position such that the limb cam 132 remains rotationally stationary while returning the bowstring 20 from the full drawn position to the undrawn position. As such, release of the bowstring 20 after completion of the final draw cycle transfers the energy input into the limbs 14 of the bow 10 from the initial, intermediate, and final draw cycles through the bowstring 20 to the arrow.

Alternative embodiments are contemplated in addition the embodiments(s) shown and/or described herein. For example, the compound bow uses an action of drawing the bowstring 20, and therefore rotation of the draw cam 134, to input energy into the limbs 14. However, the teachings disclosed herein are not limited to such configuration and other systems and methods may be used to input energy into the limbs 14 for storage and later release. Such other configurations may utilize and benefit from the cam assembly 130 and the capability to selectively decouple the limb cam 132 and the draw cam 134. As a nonlimiting example, the limb cam 132 and the draw cam 134 may be decoupled while in the initial rotational position. The limbs 14 and/or the limb cam 132 may then be manually or mechanically interacted with to input energy into the limbs 14, rotate the limb cam 132 to the final rotational position, and lock the limb cam 132 in the final rotational position. The limb cam 132 and the draw cam 134 may then be selectively coupled while the bowstring 20 is in the full draw position, and the bowstring 20 may be released to release the stored energy. Such interaction may include rotation of the limb cam 132 with a wrench.

As previously noted above, though the foregoing detailed description describes certain aspects of one or more particular embodiments of the invention [and investigations associated with the invention], alternatives could be adopted by one skilled in the art. For example, the compound bow, cam assembly 130, and their components could differ in appearance and construction from the embodiments described herein and shown in the figures, functions of certain components of the compound bow and/or the cam assembly 130 could be performed by components of different construction but capable of a similar (though not necessarily equivalent) function, and various materials could be used in the fabrication of the compound bow, the cam assembly 130, and their components. As such, and again as was previously noted, it should be understood that the invention is not necessarily limited to any particular embodiment described herein or illustrated in the drawings.

The invention claimed is:

1. A method of propelling an arrow with a compound bow comprising a pair of limbs, a bowstring, a cable, a draw cam coupled to the bowstring, and a limb cam coupled to the cable, the method comprising:

drawing the bowstring a first time to rotate the draw cam and the limb cam in a first direction;

releasing the bowstring to rotate the draw cam in an opposite direction to the first direction while the limb cam remains substantially stationary; and then drawing the bowstring a second time to rotate the draw cam and the limb cam in the first direction and thereby multiply energy stored in the limbs during the second time beyond energy stored by the limbs during the first time;

the method further comprising:

providing the bow in an initial state wherein the draw cam and the limb cam are both in an initial rotational position; and releasing the bowstring to propel an arrow notched thereon;

wherein the drawing of the bowstring the first time comprises drawing the bowstring in an initial draw cycle from an undrawn position to a full drawn position thereby causing the draw cam and the limb cam to simultaneously rotate in the first direction from the initial rotational position to final and intermediate rotational positions, respectively, and energy proportional to the drawing of the bowstring is input into the limbs of the bow;

wherein the releasing of the bowstring comprises:

returning the bowstring from the full drawn position to the undrawn position thereby causing the draw cam to rotate in the opposite direction from the final rotational position to the initial rotational position; and locking the limb cam in the intermediate position such that the limb cam remains rotationally stationary while returning the bowstring from the full drawn position to the undrawn position;

wherein the drawing of the bowstring the second time comprises drawing the bowstring in a final draw cycle from the undrawn position to the full drawn position to cause the draw cam and the limb cam to simultaneously rotate in the first direction to the final rotational position, wherein energy proportional to the drawing of the bowstring is input into the limbs of the bow;

wherein the energy input into the limbs of the bow from the initial and final draw cycles are transferred through the bowstring to the arrow; and wherein the final rotational position represents a full rotational cycle and the intermediate rotational position represents a partial rotational cycle, the method further comprising automatically decoupling the draw cam and the limb cam if the limb cam is not in the final rotational position upon initiating the rotation of the draw cam in the opposite direction.

2. The method of claim 1, further comprising decoupling the draw cam and the limb cam prior to or while returning the bowstring from the full drawn position to the undrawn position.

3. The method of claim 1, further comprising:

simultaneously rotating the draw cam and the limb cam in the first direction at first and second rotational rates, respectively, wherein the first rotational rate is greater than the second rotational rate; and simultaneously rotating the draw cam and the limb cam in the opposite direction at equal rates upon release of the bowstring.

* * * * *